US010283098B2

(12) United States Patent
Kudoh

(10) Patent No.: US 10,283,098 B2
(45) Date of Patent: May 7, 2019

(54) CONTROLLER, SOUND SOURCE MODULE, AND ELECTRONIC MUSICAL INSTRUMENT

(71) Applicant: ZOOM CORPORATION, Tokyo (JP)

(72) Inventor: Shunsuke Kudoh, Tokyo (JP)

(73) Assignee: ZOOM CORPORATION, Tokyo (JP)

( * ) Notice: Subject to any disclaimer, the term of this patent is extended or adjusted under 35 U.S.C. 154(b) by 0 days.

(21) Appl. No.: 15/768,966

(22) PCT Filed: Aug. 17, 2016

(86) PCT No.: PCT/JP2016/074035
§ 371 (c)(1),
(2) Date: Apr. 17, 2018

(87) PCT Pub. No.: WO2017/073138
PCT Pub. Date: May 4, 2017

(65) Prior Publication Data

US 2018/0301130 A1 Oct. 18, 2018

(30) Foreign Application Priority Data

Oct. 30, 2015 (JP) ..... 2015-214570

(51) Int. Cl.
*G10H 1/18* (2006.01)
*G10H 1/00* (2006.01)
(Continued)

(52) U.S. Cl.
CPC ..... *G10H 1/34* (2013.01); *G10H 1/00* (2013.01); *G10H 1/0008* (2013.01);
(Continued)

(58) Field of Classification Search
CPC ..... G10H 1/34; G10H 1/055; G10H 1/0008; G10H 2220/161; G10H 2220/395;
(Continued)

(56) References Cited

U.S. PATENT DOCUMENTS 5,170,002 A * 12/1992 Suzuki ..... G10H 1/00 84/600
5,323,678 A * 6/1994 Yould ..... G10D 13/06 84/418
(Continued)

FOREIGN PATENT DOCUMENTS

JP 2002258849 A 9/2002
JP 2004272192 A 9/2004
JP 20118284 A 1/2011

*Primary Examiner* — Jeffrey Donels
(74) *Attorney, Agent, or Firm* — The Webb Law Firm

(57) ABSTRACT

A controller to control an electronic musical instrument includes: first to third input units for a user to input play data and a frame having the first to third input units arranged therein. The frame has a wall surrounding an internal space, the wall has a three dimensional surface, the first to third input units configure one set, and the first to third input units configuring one such set are arranged adjacent in a circumferential direction of the three dimensional surface and the plurality of sets are arranged adjacent in a longitudinal direction of the three dimensional surface.

20 Claims, 8 Drawing Sheets

(51) Int. Cl.
*G10H 1/34* (2006.01)
*G10H 1/053* (2006.01)
*G10H 1/055* (2006.01)

(52) U.S. Cl.
CPC ..... *G10H 1/053* (2013.01); *G10H 1/055* (2013.01); *G10H 1/0553* (2013.01); *G10H 1/0558* (2013.01); *G10H 1/344* (2013.01); *G10H 2220/061* (2013.01); *G10H 2220/161* (2013.01); *G10H 2220/391* (2013.01); *G10H 2220/395* (2013.01); *G10H 2240/311* (2013.01); *G10H 2250/641* (2013.01)

(58) Field of Classification Search
CPC ..... G10H 2220/391; G10H 1/344; G10H 1/0558; G10H 1/0553; G10H 1/053; G10H 1/00; G10H 2240/311; G10H 2220/061; G10H 2250/641
USPC ..... 84/615
See application file for complete search history.

(56) References Cited

U.S. PATENT DOCUMENTS

| | | | | |
|---|---|---|---|---|
| 7,105,735 | B2 * | 9/2006 | Senoo | G10H 7/002 84/609 |
| 8,198,526 | B2 * | 6/2012 | Izen | G10H 3/146 84/743 |
| 2003/0076968 | A1 * | 4/2003 | Rast | G11B 19/027 381/124 |
| 2006/0075877 | A1 * | 4/2006 | Covello | G10D 13/06 84/418 |

* cited by examiner

CONTROLLER, SOUND SOURCE MODULE, AND ELECTRONIC MUSICAL INSTRUMENT

CROSS-REFERENCE TO RELATED APPLICATIONS

This application is the United States national phase of International Application No. PCT/JP2016/074035 filed Aug. 17, 2016, and claims priority to Japanese Patent Application No. 2015-214570 filed Oct. 30, 2015, the disclosures of which are hereby incorporated in their entirety by reference.

TECHNICAL FIELD

The present invention relates to a controller for a user to input play data, a sound module to control sound data based on the play data, and an electronic musical instrument including the controller and the sound module. The present invention is particularly characterized in the configuration of a controller suitable for a step sequencer.

BACKGROUND ART

A step sequencer is an electronic musical instrument that plays automatically by memorizing and replaying play data. Examples of such a step sequencer in the related art include those disclosed in Japanese Patent Application Kokai Publication No. 2004-272192 (Patent Document 1) and Japanese Patent Application Kokai Publication No. 2002-258849 (Patent Document 2).

Patent Document 1 discloses a step sequencer including 16 pads. The 16 pads are used for a user to input play data. One pad corresponds to a step of play. A user can input play data for 16 steps using 16 pads. A general step sequencer is capable of setting, for example, one bar to 16 steps, eight steps, or step(s) of an arbitrary number.

A general step sequencer plays automatically using sound data of different parts and different tone timbres, such as drums, a bass guitar, a guitar, and a piano, for example. A user can input play data for 16 steps for each part. As a result, play data of a plurality of parts is assigned to one step. The play data includes information, such as a note number, step time, gate time, velocity, after touch, and tempo. Among them, the play data input with the pads is step time, gate time, velocity, and after touch. The step time is a value indicating timing of a pad being pressed. The gate time is a value representing the time between pressing a pad and releasing the pad. The velocity is a value representing the magnitude of the force of pressing a pad. The after touch is information on an operation of, after pressing a pad once, further pressing the pad. A CPU provided in the step sequencer replays the sound data of each part in accordance with the play data assigned to one to 16 steps.

Patent Document 2 discloses a step sequencer, including: 16 pads; and a linear display unit divided into one to 16 areas. The one to 16 areas of the display unit correspond to one to 16 steps of play. The display unit indicates the currently executed step number by illuminating the one to 16 areas during automatic play.

PRIOR ART DOCUMENT

Patent Document

Patent Document 1: Japanese Patent Application Kokai Publication No. 2004-272192

Patent Document 2: Japanese Patent Application Kokai Publication No. 2002-258849

SUMMARY OF THE INVENTION

Problems to be Solved by the Invention

<Problem on Playing>

Musical instruments, such as drums, a bass guitar, a guitar, and a piano, offer the pleasure of playing. In contrast, step sequencers in the past lack in the pleasure of playing a musical instrument. That is, a step sequencer in the past is configured to have switches, knobs, pads, and a display unit at the front of a box housing and is used in a state of being placed on a table. Given this situation, playing such a step sequencer in the past is not different from operation of a general electrical device. For example, in a live performance, a player of a step sequencer in the past cannot move around on the stage and express the music by body language. As just described, being played extremely statically, the step sequencer in the past lacks in interest for both the player and the audience.

<First Problem on Display>

The step sequencer in the past is capable of assigning play data of a plurality of parts to one step. The step sequencer in the past, however, used not to be capable of displaying the state of all the play data items assigned to one step. A user thus cannot visually confirm how the play data of each part is assigned to one step. Further, a user cannot visually confirm how the play data of each part is assigned in the entire bar.

<Second Problem on Display>

The step sequencer in the past visually displays the currently executed step using the linear display unit divided into one to 16 areas. The display in the past to illuminate the one to 16 areas from right to left in order, however, merely indicates the currently executed step number and the amount of information is scarce by far. In addition, the linear display with the start and the end does not match the state of repeated automatic play. Moreover, the display in the past is monotonous and lacks in visual interest and complexity.

The present invention has been made in view of the above problems and it is an object thereof to provide a controller for an electronic musical instrument exhibiting the following technical effects:

- allowing an operation like playing a musical instrument;
- allowing display of the state of all or part of play data assigned to each step;
- allowing display matching automatic play by a loop sequence; and
- allowing the above operation and display to be novel and interesting.

Means to Solve the Problems (1) To achieve the above object, the controller of the present invention is a controller to control an electronic musical instrument, including: an input unit for a user to input play data; and a frame having the input unit arranged therein, wherein the frame has a wall surrounding an internal space, the wall has a three dimensional surface, a plurality of such input units configure one set, and the plurality of such input units configuring one such set are arranged adjacent in a circumferential direction of the three dimensional surface and a plurality of such sets are arranged adjacent in a longitudinal direction of the three dimensional surface.

(2) It is preferred that, in the controller of (1) above, the frame has a hoop shape.

(3) It is preferred that, in the controller of (1) or (2) above, the plurality of such input units configuring the plurality of such sets are arranged in a matrix on the three dimensional surface.

(4) It is preferred that, in the controller of any one of (1) through (3) above, the input unit includes a pressure sensitive sensor.

(5) It is preferred that, in the controller of (4) above, the pressure sensitive sensor includes a resistive film pattern and a wiring pattern provided between a plurality of sheets.

(6) It is preferred that, in the controller of (4) above, the pressure sensitive sensor includes a resistive film pattern and a wiring pattern provided between a sheet and a substrate.

(7) It is preferred that, in the controller of any one of (4) through (6) above, the plurality of such input units includes one pressure sensitive sensor unit including a plurality of such pressure sensitive sensors.

(8) It is preferred that, in the controller of any one of (4) through (7) above, the input unit includes a resilient pad to transmit pressure to the pressure sensitive sensor.

(9) It is preferred that, in the controller of any one of (1) through (8) above, the input unit includes an LED.

(10) It is preferred that the controller of any one of (1) through (9) above further includes an acceleration sensor.

(11) It is preferred that the controller of any one of (1) through (10) above further includes a vibration motor.

(12) It is preferred that, in the controller of any one of (1) through (11) above further includes an infrared sensor.

(13) It is preferred that, in the controller of any one of (1) through (12) above further includes a gyro sensor.

(14) It is preferred that, in the controller of any one of (1) through (13) above, the electronic musical instrument is a step sequencer, the plurality of such input units adjacent in the circumferential direction of the three dimensional surface are configured to be used to respectively control different sound data items, and the plurality of such input units adjacent in the longitudinal direction of the three dimensional surface are configured to be used to respectively control a same sound data item.

(15) It is preferred that, in the controller of (14) above, the plurality of such input units configuring one such set correspond to one step of play, and a plurality of such sets corresponding to at least one to 16 steps are arranged adjacent in the longitudinal direction of the three dimensional surface.

(16) It is preferred that, in the controller of any one of (1) through (15) above, the electronic musical instrument includes a sound module configured to control the sound data based on the play data, and the controller is a device independent from the sound module and is configured to send the play data to the sound module via wireless or wired communication.

(17) It is preferred that the controller of (16) above further includes: a control unit to process a signal outputted from the input unit and send the play data to the sound module; and a power supply to operate the controller.

(18) To achieve the above object, a sound module of the present invention is configured to control the sound data based on the play data sent from the controller according to (16) or (17) above.

(19) To achieve the above object, an electronic musical instrument of the present invention includes the controller according to any one of (1) through (15) above.

(20) To achieve the above object, an electronic musical instrument of the present invention includes: the controller according to (16) or (17) above; and the sound module according to (18) above.

Effects of the Invention

The controller of the present invention includes: a frame having a three dimensional surface; and a plurality of input units arranged adjacent in a circumferential direction and a longitudinal direction of the three dimensional surface. This configuration allows more input units to be provided on the three dimensional surface of the frame. As a result, a controller in a shape and size easy to carry is achieved. A user can operate the input unit like playing a musical instrument by holding the controller of the present invention and further can freely move on the stage and freely move the body with the performance. In other words, the controller of the present invention allows dynamic play by a user to fulfill the live performance more.

The controller of the present invention provides particularly effective display when applied to a step sequencer. The controller of the present invention allows more input units to be provided on the three dimensional surface of the frame. All the input units are capable of visually displaying information by, for example, being provided with an LED. A large number of input units provided with a display function allow display of the state of play data of all parts assigned to each step. For example, a user can visually confirm how the play data of each part is assigned in the entire bar based on the display of the large number of input units.

Further, arrangement of the large number of input units is determined by the shape of the entire frame. For example, when the entire frame has a hoop shape, the large number of input units are arranged adjacent in a loop on the three dimensional surface of the frame. Such arrangement allows the large number of input units to display information continuously in a loop. The form of display in a loop matches, for example, information display during automatic play by a loop sequence.

The controller of the present invention provides novel operation and display that are not found in electronic musical instruments in the past. For example, arrangement of the large number of input units indicates parts and steps subjected to play data input. A user can intuitively input play data based on the arrangement of the large number of input units. The display of the large number of input units dynamically changes in the circumferential direction and the longitudinal direction of the three dimensional surface with automatic play. Such display offers, in addition to an effect of providing more detailed information, a presentation effect to visually express the music.

BRIEF DESCRIPTION OF THE DRAWING

FIG. 1A is a plan view and FIG. 1B is a bottom view.

FIG. 3A is a bottom view illustrating resistive film pattern sheets, FIG. 3B is a plan view illustrating spacers, and FIG. 3C is a plan view of a wiring pattern sheet. FIG. 3D is a bottom view illustrating resistive film pattern sheets and FIG. 3E is a plan view illustrating spacers.

FIG. 8A is a plan view, FIG. 8B is a right side view, and FIG. 8C is a left side view.

EMBODIMENTS TO CARRY OUT THE INVENTION

A description is given to a controller, a sound module, and an electronic musical instrument according to embodiments of the present invention with reference to the drawings. An electronic musical instrument in the present embodiment is a step sequencer configured with a controller 1 illustrated in FIG. 1 and a sound module 2 illustrated in FIG. 8.

<Controller>

Figure 1A:
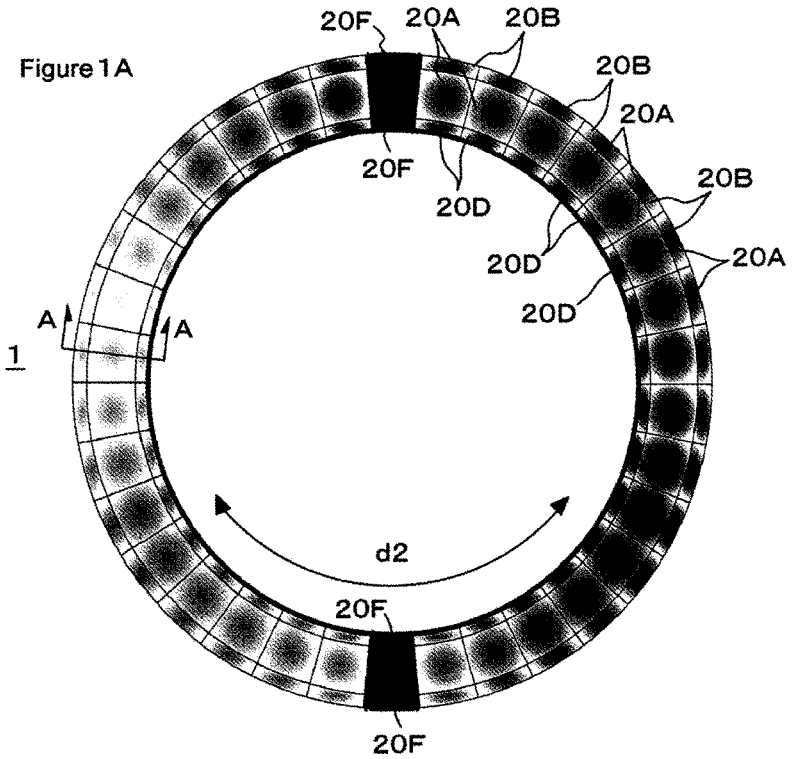
FIGS. 1A and 1B illustrate a controller of an embodiment, where
Figure 1B:
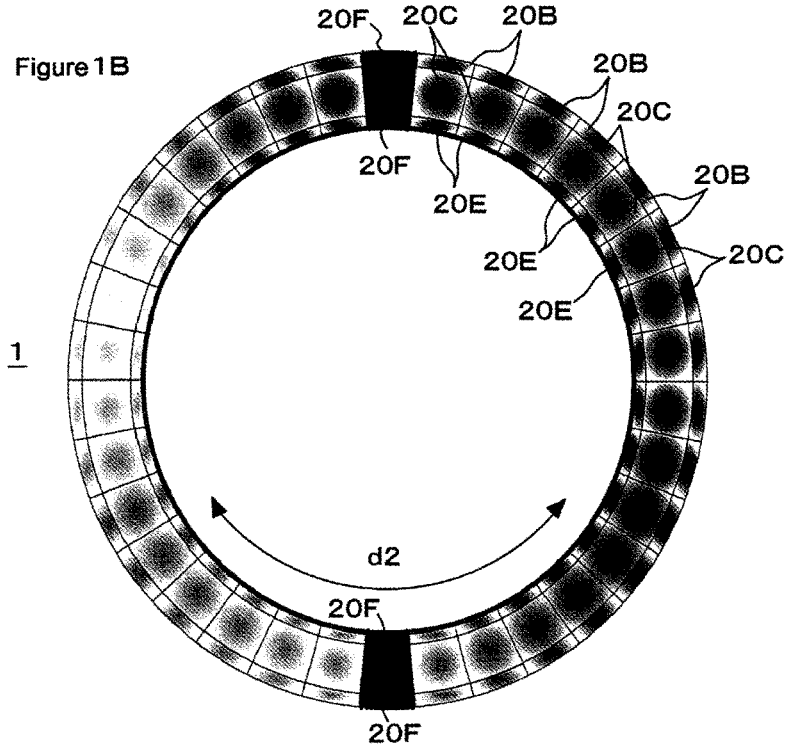
Figure 2:
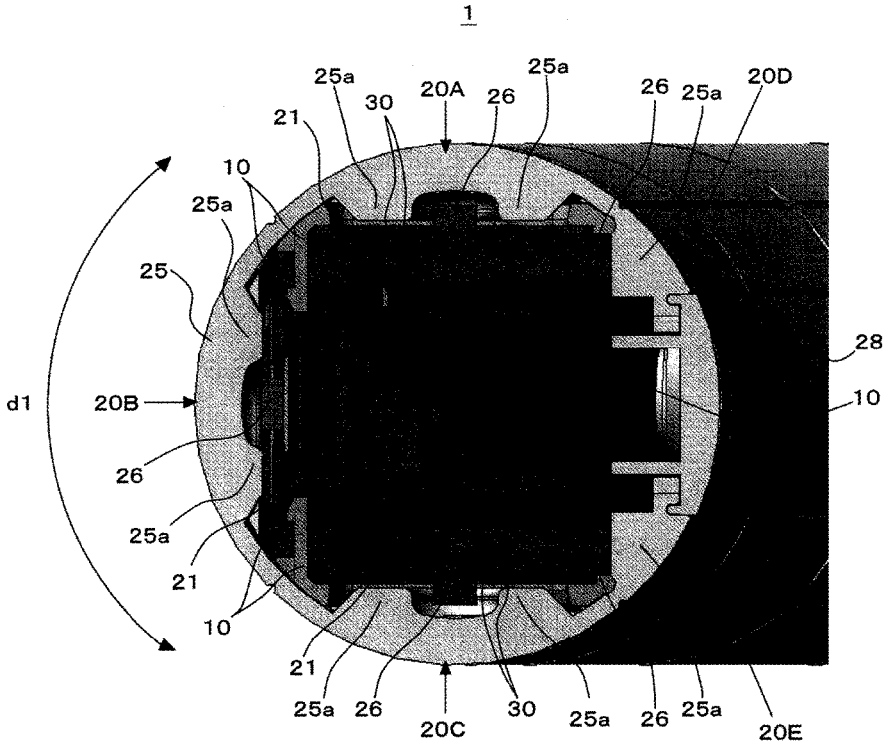
FIG. 2 is a cross sectional view taken along the line A-A in FIG. 1A.

FIGS. 1A and 1B illustrate an external appearance of the controller 1 in the present embodiment. FIG. 2 illustrates a cross section of the controller. The entire controller 1 has a hoop shape. The cross section of the controller 1 has an approximately circular outline. In the description below, the directions illustrated by arrows d1 in FIG. 2 are defined as "a circumferential direction" of the controller 1. The directions illustrated by arrows d2 in FIGS. 1A and 1B are defined as "a longitudinal direction" of the controller 1.

As illustrated in FIGS. 1A and 1B, the controller 1 includes first input units 20A, second input units 20B, third input units 20C, dummy input units 20D and 20E, and control switches 20F. In a right half and a left half of the controller 1, the large number of first input units 20A, second input units 20B, third input units 20C, and dummy input units 20D and 20E are aligned in the circumferential direction d1 and the longitudinal direction d2 to be arranged in a matrix. In two areas located between the right half and the left half of the controller 1, the plurality of control switches 20F are provided. In the two areas, respective six control switches 20F are arranged adjacent in the circumferential direction d1.

The first to third input units 20A to 20C are configured to allow input of play data and display of information. The dummy input units 20D and 20E form an external appearance same as that of the first to third input units 20A to 20C. The dummy input units 20D and 20E are configured to allow display of information but not to allow input of play data. The control switches 20F are used to control the state of the controller 1 or the sound module 2.

The three input units 20A, 20B, and 20C and the two dummy input units 20D and 20E arranged in the circumferential direction d1 of the controller 1 configure one set. A plurality of such sets are arranged adjacent in the longitudinal direction d2 of the controller 1. In the present embodiment, 16 sets are provided in the right half of the controller 1 and 16 sets are provided in the left half. One such set corresponds to one step of play. One to 16 sets correspond to one to 16 steps of play. One to 32 sets correspond to one to 32 steps of play. In other words, the controller 1 in the present embodiment is capable of setting 32 steps at the maximum to one bar. When 16 steps are set to one bar, input of play data and display of information corresponding to two bars are allowed.

In this situation, the three input units 20A, 20B, and 20C included in one set are used to input three or more play data items assigned to one step of play. In other words, the three input units 20A, 20B, and 20C are used to respectively control sound data items of different parts and different tone timbres. Further, by changing a state of control of the controller 1 using the control switches 20F, the three input units 20A, 20B, and 20C may also be used for input of four or more play data items. The number of play data items assigned to one step is not particularly limited and is determined by performance of the sound module 2. For example, the three input units 20A, 20B, and 20C may be used together to assign 32 play data items to one step of play.

Each first input unit 20A included in all sets is aligned in the longitudinal direction d2 of the controller 1 to be arranged circularly. Similarly, each second input unit 20B, each third input unit 20C, each dummy input unit 20D, and each dummy input unit 20E are also aligned in the longitudinal direction d2 of the controller 1 to be arranged circularly. Each first input unit 20A, each second input unit 20B, each third input unit 20C, each dummy input unit 20D, and each dummy input unit 20E thus configure five loops on a surface of the controller 1. Each of the five loops visually displays the presence of play data items assigned to one to 32 steps.

<<Internal Structure>>

The internal structure of the controller 1 in the present embodiment is then described. As illustrated in FIG. 2, inside the controller 1, a hollow frame 10 is provided. Although not shown, the entire frame 10 has a hoop shape extended in the longitudinal direction d2. The frame 10 in the present embodiment is composed of a plurality of components and has a wall surrounding an internal space. The wall of the frame 10 has a three dimensional surface including a plurality of planes.

For example, the three dimensional surface of the frame 10 in the present embodiment includes an upper surface, an outer side surface, and a lower surface surrounding the internal space. As illustrated in FIGS. 1A and 1B, the upper surface, the outer side surface, and the lower surface of the frame 10 are provided with the respective first to third input units 20A to 20C. The upper surface and the lower surface of the frame 10 are respectively configured with a pair of left and right planes mainly having a semicircular outline. Meanwhile, the outer side surface of the frame 10 is configured mainly with 32 rectangular planes. Half of the outer side surface of the frame 10 is configured with 16 rectangular planes. The 16 rectangular planes as a whole form a semicircular outline.

Meanwhile, the frame 10 has an inner side surface with an upper portion and a lower portion provided with the respective dummy input units 20D and 20E. Between the upper portion and the lower portion of the inner side surface of the frame 10, coupling structures are provided to attach a plurality of inner walls 28. The inner walls 28 are arcuate components along the inner side surface of the frame 10 and configure an external appearance of the inner side surface of the controller 1.

Each of the first to third input units 20A to 20C includes a pressure sensitive sensor 21, a pad 25, and an LED 26. Each of the dummy input units 20D and 20E includes a pad 25 and an LED 26. All LEDs 26 are connected to identical or different circuit substrates 30. In this situation, the first to third input units 20A to 20C in the present embodiment are configured with a pressure sensitive sensor unit 21 including a plurality of pressure sensitive sensors 21. Configuration of the pressure sensitive sensor unit 21 is described later.

The pads 25 in the present embodiment are made of a synthetic resin having elasticity and translucency. Each pad 25 in the present embodiment has a strip shape corresponding to eight sets of the first to third input units 20A to 20C and the dummy input units 20D and 20E. To configure one to 32 sets of the first to third input units 20A to 20C and the dummy input units 20D and 20E, four strip pads 25 are used. The strip pads 25 cover the area from the upper portion of the inner side surface of the frame 10 through the upper surface, the outer side surface, the lower surface, and to the lower portion of the inner side surface. Both ends of the strip pads 25 are fixed by the inner walls 28.

Each pad 25 may have a strip shape corresponding to each set of the first to third input units 20A to 20C and the dummy input units 20D and 20E. In this case, 32 strip pads 25 are used. As another example, each pad 25 may have a tubular shape corresponding to 16 sets of the first to third input units 20A to 20C and the dummy input units 20D and 20E in the right or left half of the controller 1. In this case, two tubular pads 25 are used.

An underside of the pad 25 is provided with a plurality of press pieces 25*a* corresponding to the first to third input units 20A to 20C and the dummy input units 20D and 20E. The press pieces 25*a* transmit the pressure of pressing the pads 25 to the pressure sensitive sensor 21. The press pieces 25*a* further play a role of light guides to effectively guide the light of the LEDs 26 to the surface of the pads 25. As the LEDs 26 in the present embodiment, full color LEDs are used. The LEDs 26 are capable of displaying various types of information by turning on and off and luminous color.

The pressure sensitive sensor units 21 are then described with reference to FIGS. 3A to 3E. As described above, each of the first to third input units 20A to 20C includes one pressure sensitive sensor 21. In the present embodiment, the plurality of pressure sensitive sensors 21 are configured with one pressure sensitive sensor unit 21.

Figure 3:
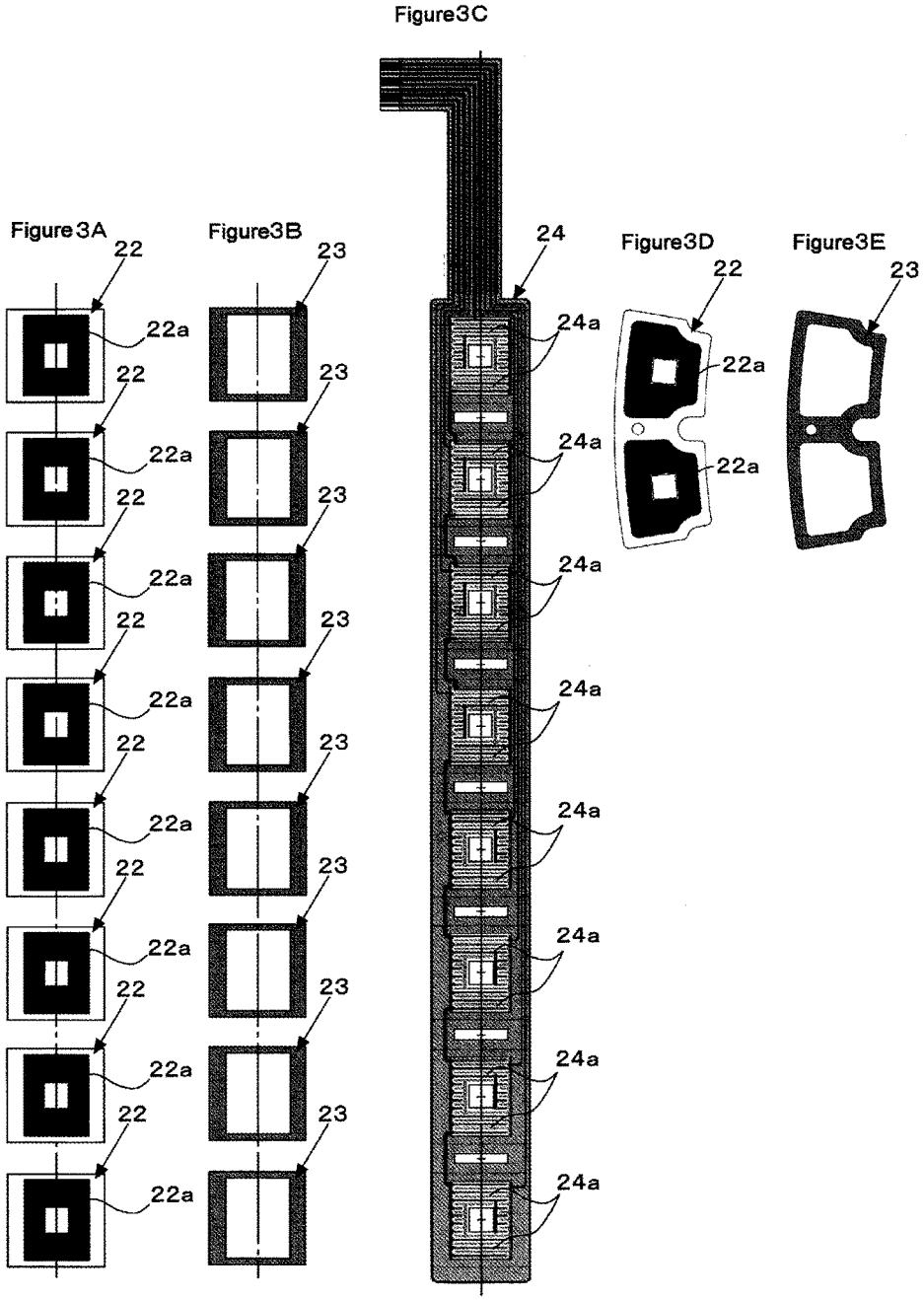
FIGS. 3A to 3C are exploded views illustrating a pressure sensitive sensor unit configuring a plurality of second input units, where
FIGS. 3D and 3E are exploded views illustrating a pressure sensitive sensor unit configuring a plurality of first or third input units, where

The pressure sensitive sensor units 21 configuring the plurality of second input units 20B are described first. FIGS. 3A to 3C are exploded views of one pressure sensitive sensor unit 21 configuring eight second input units 20B. Each pressure sensitive sensor unit 21 configuring the plurality of second input units 20B includes eight resistive film pattern sheets 22 illustrated in FIG. 3A, eight spacers 23 illustrated in FIG. 3B, and one wiring pattern sheet 24 illustrated in FIG. 3C.

On the underside of each resistive film pattern sheet 22, a pattern of a resistive film 22*a* is formed. A material for the resistive films 22*a* is not particularly limited. The resistive films 22*a* may be formed by, for example, a pressure sensitive semiconductor having carbon or the like as a main component. At the center of each resistive film 22*a*, a hole corresponding to the LED 26 illustrated in FIG. 2 is provided.

The spacers 23 are frame-like sheets and have adhesive properties. The spacers 23 adhere the resistive film pattern sheets 22 on the wiring pattern sheet 24 and form minute gaps between the resistive film pattern sheets 22 and the wiring pattern sheet 24.

On a surface of the wiring pattern sheet 24, eight wiring patterns 24*a* are formed. At the center of each wiring pattern 24*a*, a hole corresponding to the LED 26 illustrated in FIG. 2 is provided. Each of the eight resistive film pattern sheets 22 described above is laminated over the wiring pattern 24*a* via the spacer 23. The resistive films 22*a* and the wiring patterns 24*a* are arranged facing each other via the minute gaps. The resistive films 22*a* and the wiring patterns 24*a* thus configure the pressure sensitive sensor 21 to change the resistance in accordance with the contact area with each other. Over the one wiring pattern sheet 24, eight pressure sensitive sensors 21 are configured. In other words, with the one pressure sensitive sensor unit 21, the eight second input units 20B are configured.

The pressure sensitive sensor unit 21 configuring the eight second input units 20B is adhered to the outer side surface of the frame 10 illustrated in FIG. 2. As described above, the outer side surface of the frame 10 is configured mainly with 32 rectangular planes. Accordingly, the frame 10 has an outer surface with four pressure sensitive sensor units 21 adhered thereto. The 32 pressure sensitive sensors 21 included in the four pressure sensitive sensor units 21 are adhered respectively to 32 rectangular planes.

The pressure sensitive sensor units 21 configuring the plurality of first and third input units 20A and 20C are then described. The pressure sensitive sensor units 21 configuring the plurality of first input units 20A has configuration identical to that of the pressure sensitive sensor units 21 configuring the plurality of third input units 20C. Accordingly, a description is given to the pressure sensitive sensor units 21 configuring the plurality of first input units 20A and the description on the pressure sensitive sensor units 21 configuring the plurality of third input units 20C is omitted.

Each pressure sensitive sensor unit 21 configuring the plurality of first input units 20A includes the resistive film pattern sheet 22 illustrated in FIG. 3D, the spacer 23 illustrated in FIG. 3E, and wiring pattern formed on the circuit substrate 30 illustrated in FIG. 2. On the circuit substrate 30, wiring pattern same as that of the wiring pattern 24*a* illustrated in FIG. 3C is formed. As described above, the upper surface of the frame 10 is configured mainly with the pair of left and right planes having a semicircular outline. The upper surface of the frame 10 is provided with, for example, four arcuate circuit substrates 30. Each circuit substrate 30 has a length equivalent to approximately ¼ of the circumference. Each circuit substrate 30 has the eight wiring patterns 24*a* illustrated in FIG. 3C formed in arcuate alignment. The resistive film pattern sheet 22 illustrated in FIG. 3D has a shape corresponding to the two wiring patterns 24*a* formed in arcuate alignment. The spacer 23 illustrated in FIG. 3E is same. Over the eight wiring patterns 24*a* formed on the circuit substrate 30, four resistive film pattern sheets 22 are laminated via four spacers 23. The eight pressure sensitive sensors 21 are thus configured on each circuit substrate 30. In other words, eight first input units 20A are configured with the one pressure sensitive sensor unit 21, and 32 first input units 20A are configured with the four pressure sensitive sensor units 21. The pressure sensitive sensor units 21 configuring the plurality of third input units 20C also has configuration same as that in the above description.

Figure 4:
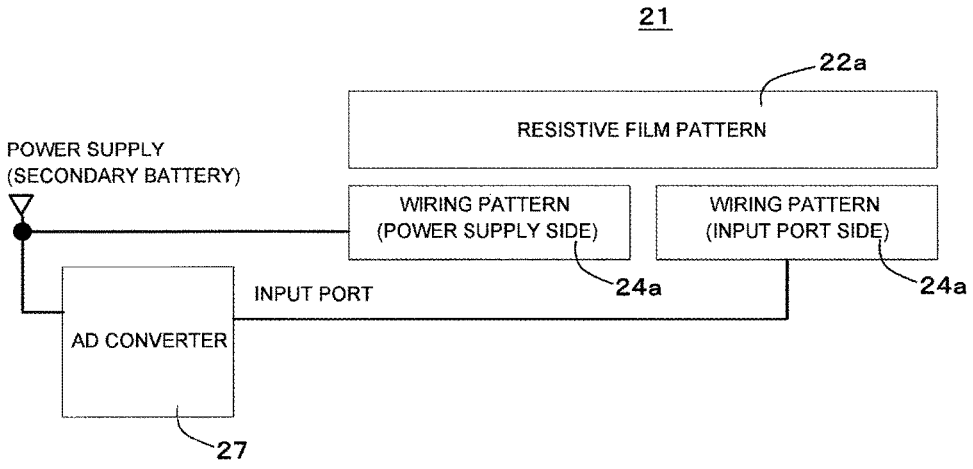
FIG. 4 is a block diagram schematically illustrating a circuit of the pressure sensitive sensor.

FIG. 4 illustrates a circuit configuration of one of the pressure sensitive sensors 21. One wiring pattern 24*a* is divided into two. One of the wiring patterns 24*a* is connected to a power supply (secondary battery). The other wiring pattern 24*a* is connected to an input port of an AD converter 27. The AD converter 27 is connected to the power supply. The wiring pattern 24*a* divided into two is electrically conducted by contact with the resistive film 22*a*. First, the resistive film 22*a* and the wiring pattern 24*a* change the resistance in accordance with the contact area with each other. Second, the resistive film 22*a* changes the resistance in accordance with the applied pressure. As a result, when the pads 25 configuring the first to third input units 20A to 20C are not pressed, the resistive film 22*a* and the wiring pattern 24*a* are not in contact and the voltage applied to the input port of the AD converter 27 becomes 0 V. In contrast, when the pads 25 configuring the first to third input units 20A to 20C are pressed, the resistive film 22*a* and the wiring pattern 24*a* are in contact and the voltage applied to the input port of the AD converter 27 changes in accordance with the contact area and the pressure at this point. Based on the change in voltage, various types of play data can be obtained. For example, based on occurrence of a voltage, a note-on command is generated. Such a note-on command is generally a command of making a sound. In contrast, based on elimination of a voltage, a note-off command is generated. Such a note-off command is generally a command of stopping a sound. Based on the input port to which the voltage is applied, which one of the input units 20A to 20C is operated is specified. Based on the timing when the voltage is applied, the step time is specified. Based on the time between occurrence and elimination of a voltage, the gate time is specified. Based on the magnitude of the applied voltage, the velocity is specified. Based on a later increase in the first applied voltage, the after touch is specified. A change in voltage by the pressure sensitive sensor 21 is further used for process other than generation of play data, such as detection of a state of the controller 1, for example.

In this situation, configuration of the three dimensional surface of the frame 10 with the plurality of planes achieves an effect of increasing the dynamic range of the pressure sensitive sensors 21. That is, the pressure sensitive sensors 21 provided on the planes allow parallel arrangement of the resistive film pattern sheets 22 and the wiring pattern sheet 24 and uniform formation of gaps between the resistive films 22*a* and the wiring patterns 24*a*. The pressure sensitive sensors 21 are provided on the planes, and the pressure from the press pieces 25*a* of the pads 25 is thus accurately transmitted to the pressure sensitive sensors 21. As a result, the pressure sensitive sensors 21 are allowed to detect the pressure when the pads 25 are pressed in a wide dynamic range.

Meanwhile, when the three dimensional surface of the frame 10 is made of a curved surface, the pressure sensitive sensors 21 are provided in a curved state. Given this situation, the resistive films 22*a* and the wiring patterns 24*a* have a possibility of partial contact at all time. To the pressure sensitive sensors 21 in a curved state, the pressure from the press pieces 25*a* of the pads 25 is not accurately transmitted. As a result, the pressure sensitive sensors 21 have a narrower dynamic range and lower pressure detection accuracy. Note that the curve of the pressure sensitive sensors 21 is reduced more as the area of the pressure sensitive sensors 21 is less. For this reason, when the area of the input units are reduced and the number of input units is increased, the three dimensional surface of the frame 10 may be a curved surface.

<<Circuit Configuration>>

Figure 5:
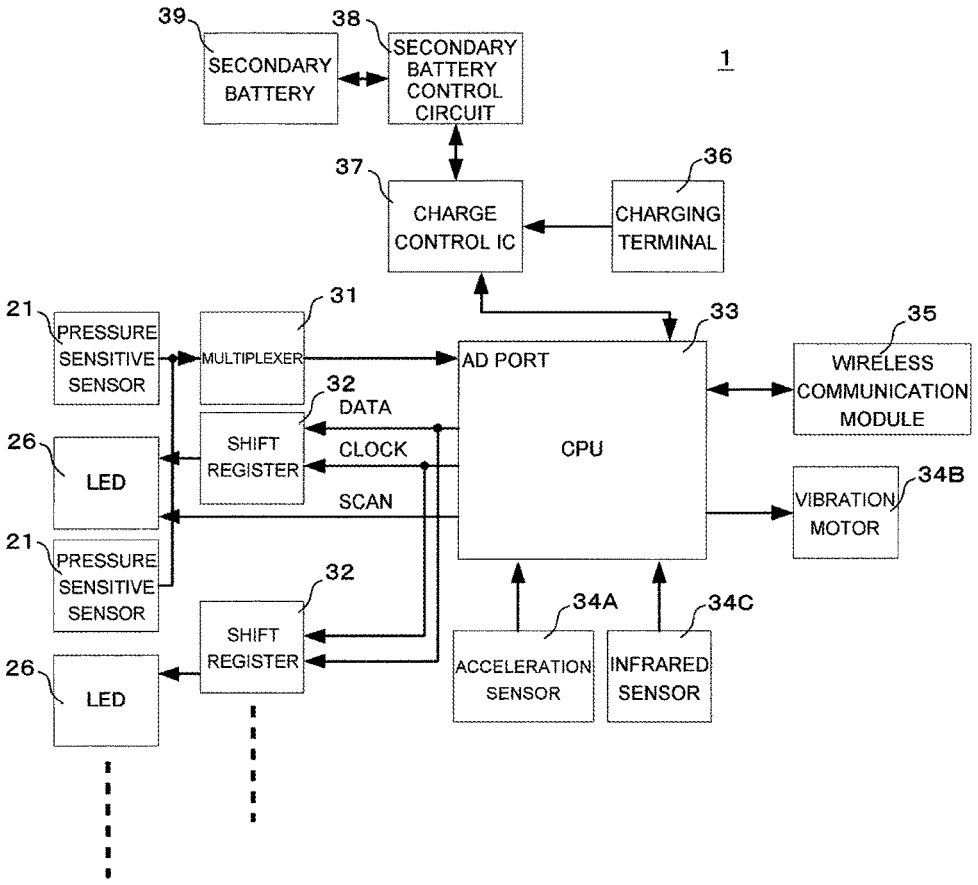
FIG. 5 is a block diagram schematically illustrating a circuit of the controller.

The circuit configuration of the controller 1 in the present embodiment is then described. FIG. 5 illustrates a main circuit configuring the controller 1. The controller 1 includes the pressure sensitive sensors 21, the LEDs 26, a multiplexer 31, shift registers 32, a CPU 33, an acceleration sensor 34A, a vibration motor 34B, an infrared sensor 34C, a wireless communication module 35, a charging terminal 36, a charge control IC 37, a secondary battery control circuit 38, and a secondary battery 39.

The controller 1 includes 96 pressure sensitive sensors 21 corresponding to all first to third input units 20A to 20C. The 96 pressure sensitive sensors 21 are connected to an AD port of the CPU 33 via the multiplexer 31. As described above, the pressure sensitive sensors 21 output voltage signals having a value in accordance with the operation of the pads 25. The multiplexer 31 outputs the voltage signals inputted from the 96 pressure sensitive sensors 21 as one signal to the CPU 33. The CPU 33 converts the inputted voltage signal to a digital signal and outputs the signal to the wireless communication module 35. The digital signal generated by the CPU 33 is sent to the sound module 2 illustrated in FIG. 8 by the wireless communication module 35. Meanwhile, the wireless communication module 35 receives the digital signal sent from the sound module 2 and outputs the signal to the CPU 33. The CPU 33 executes control process based on the digital signal from the sound module 2. The controller 1 is further capable of sending and receiving a digital signal with electronic devices, such as a personal computer and a personal data assistance.

The controller 1 includes 160 LEDs 26 corresponding to all the first to third input units 20A to 20C and the dummy input units 20D and 20E. The CPU 33 controls each LED 26 based on predetermined settings, the voltage signal of each pressure sensitive sensor 21, the digital signal of the sound module 2, and the like. Each LED 26 is connected to the CPU 33 via the respective shift register 32. Each LED 26 is controlled by the shift register 32 to be shifted in scan timing. Such control allows the 160 full color LEDs 26 to be presented as if they were illuminated at the same time with low power consumption. The controller 1 includes 12 LEDs corresponding to all control switches 20F. Although not shown, the LEDs for all control switches 20F are also controlled by the CPU 33.

Figure 6:
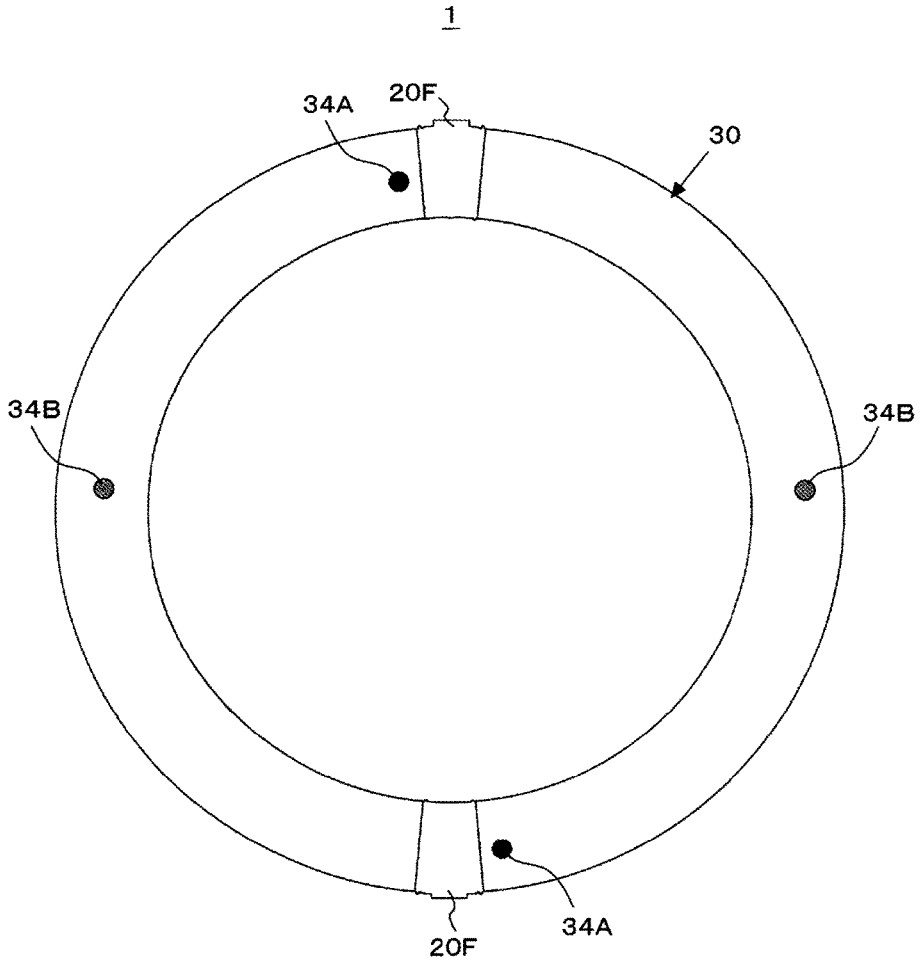
FIG. 6 is a schematic diagram illustrating arrangement of an acceleration sensor, a vibration motor, and a gyro sensor provided in the controller.

The controller 1 includes two acceleration sensors 34A illustrated in FIG. 6. The two acceleration sensors 34A are arranged in symmetrical positions in the hoop shape of the controller 1. Both acceleration sensors 34A are arranged in positions away from the vibration motor 34B. Such arrangement allows the detection result by the acceleration sensors 34A not to be affected by the holding position of the controller 1 by the user. Each acceleration sensor 34A is implemented to the respective circuit substrate 30 illustrated in FIG. 2.

The CPU 33 determines the position of the controller 1 based on the detection result of each acceleration sensor 34A. That is, the CPU 33 obtains the detection result of each acceleration sensor 34A at predetermined time interval and calculates the inclination of the controller 1 to the x axis, the y axis, and the z axis. The CPU 33 performs various types of control process based on the position of the controller 1.

The CPU 33 first determines whether the controller 1 is held by a user based on the position of the controller 1. That is, the CPU 33 calculates a synthetic vector of the x axis, the y axis, and the z axis of the controller 1. When the synthetic vector changes more than a predetermined threshold, the CPU 33 determines that the controller 1 is held by a user. The CPU 33 then determines which of the first to third input units 20A to 20C is held by the user based on the voltage signal from the first to third input units 20A to 20C. The CPU 33 specifies which of the first to third input units 20A to 20C is held by the user based on, for example, the number of input units outputting a voltage signal and the time of continuous output of the voltage signals. The CPU 33 is further capable of specifying which of the first to third input units 20A to 20C is held by the user based on information, such as the gate time, the velocity, and the after touch obtained from the voltage signal. The CPU 33 then cancels the voltage signal outputted from the first to third input units 20A to 20C held by the user. The CPU 33 thus specifies which of the first to third input units 20A to 20C is used for input of play data. The CPU 33 then converts only the voltage signal inputted as play data to a digital signal to be sent to the sound module 2. Employment of the above control process allows more input units 20A to 20C to be provided on the surface of the controller 1. Further, the controller 1 does not have to include a gripper and the entire controller 1 can be designed simply.

The CPU 33 second manages power consumption based on the position of the controller 1. For example, when the synthetic vector of the x axis, the y axis, and the z axis of the controller 1 does not change continuously for a predetermined time period, the CPU 33 switches the state of control to a power saving mode or turns off the power. In this case, the CPU 33 also determines that all first to third input units 20A to 20C and all control switches 20F output no signal within the predetermined time period and no signal from the sound module 2 is inputted.

The CPU 33 third allows gesture input by a user based on the position of the controller 1. For example, the CPU 33 is capable of determining rotation and shaking of the controller 1 and further the direction of rotation, the number of shaking, and the like based on the detection result of each acceleration sensor 34A. The CPU 33 is capable of performing various types of control process based on a gesture of the user using the controller 1. For example, the CPU 33 starts automatic play of the sound module 2 based on clockwise rotation of the controller 1. For example, the CPU 33 stops automatic play of the sound module 2 based on counter-clockwise rotation of the controller 1. For example, the CPU 33 gives sound effects to automatic play of the sound module 2 based on the number of shaking of the controller 1. Employment of the above gesture input allows a user to perform various types of gesture input with automatic play. As a result, dynamic play that is not found in step sequencers in the past is achieved. Further, employment of gesture input allows omission of operation units, such as buttons, switches, and knobs, provided in the controller 1.

The controller 1 includes two vibration motors 34B illustrated in FIG. 6. The two vibration motors 34B are arranged in symmetrical positions in the hoop shape of the controller 1. Both vibration motors 34B are arranged in positions away from the acceleration sensors 34A. Such arrangement allows the vibration of the vibration motors 34B not to affect the detection result of the acceleration sensors 34A. Even when a user holds any portion of the controller 1, sufficient vibration is transmitted to the hand of the user. Each vibration motor 34B is implemented to the respective circuit substrate 30 illustrated in FIG. 2.

The vibration motors 34B are first used to transmit rhythm tempo set by the sound module 2 to the user by vibration. The CPU 33 vibrates the vibration motors 34B based on the information on the rhythm tempo set in the sound module 2. The rhythm tempo expressed by the vibration is transmitted to the hand of the user holding the controller 1. In this situation, step sequencers in the past are configured to be used by a user in a state of being placed on a table. Due to this configuration, such a step sequencer in the past transmits rhythm tempo to the user by, for example, the sound outputted to headphones. The sound to transmit the rhythm tempo has a problem of inhibiting the play sound. In contrast, the controller 1 in the present embodiment is configured to be used in a state of being held by a user. This configuration allows transmission of the rhythm tempo set in the sound module 2 by vibration. The vibration to transmit the rhythm tempo has an effect of not inhibiting the play sound.

The vibration motors 34B are second used to give feedback to an input operation by the user. The CPU 33 vibrates the vibration motors 34B based on signals from the first to third input units 20A to 20C and the control switches 20F. The vibration feedback is transmitted to the hand of the user holding the controller 1. As a result, the user can confirm that the input operation is performed normally.

Figure 7:
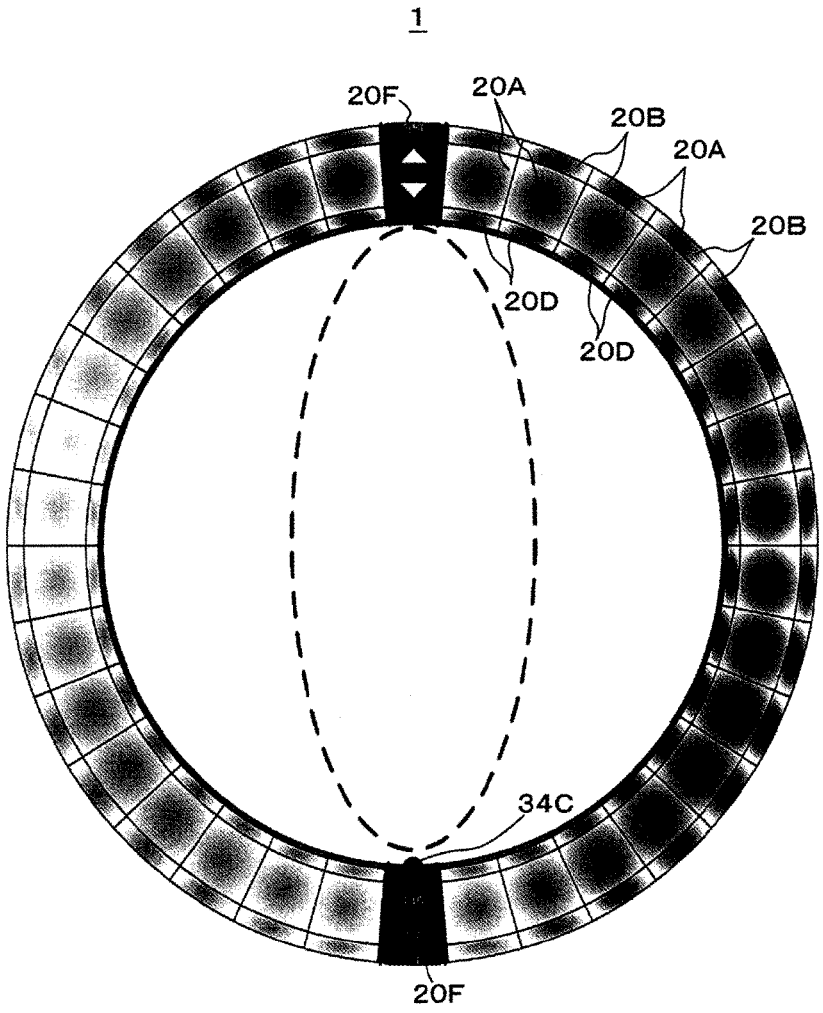
FIG. 7 is a plan view illustrating arrangement of an infrared sensor provided in the controller.

The controller 1 includes one infrared sensor 34C illustrated in FIG. 7. The infrared sensor 34C is arranged in one of the two areas having the control switches 20F. The infrared sensor 34C is directed inside the hoop shape of the controller 1. The infrared sensor 34C includes a light emitting portion and a light receiving portion, not shown. The light emitting portion emits infrared light. The infrared light reflected by an object enters the light receiving portion. The light receiving portion detects a distance to the object based on the entrance position of the infrared light. For example, the light receiving portion changes the resistance in accordance with the distance to the object. The broken line in FIG. 7 illustrates a detection range of the infrared sensor 34C. The CPU 33 is capable of determining insertion of the object into the hoop of the controller 1 based on the detection result of the infrared sensor 34C and measuring the distance to the object.

The CPU 33 performs various types of control process based on the insertion of the object into the hoop of the controller 1 and the distance to the object. As a result, gesture input by a user is allowed using the hoop shape of the controller 1. For example, a user can input a command to the controller 1 by putting the hand or the arm through the hoop. The distance from the infrared sensor 34C to the object is assigned to a specific parameter. The user can operate various parameters, such as the magnitude of volume and the intensity of sound effects, for example, by moving the hand close to or away from the infrared sensor 34C. The number of infrared sensor 34C is not particularly limited and the controller 1 may be configured with two or more infrared sensors 34C.

The controller 1 communicates with the sound module 2 via the wireless communication module 35 illustrated in FIG. 5. The sound module 2 includes a wireless communication module 66 illustrated in FIG. 9. The mode of wireless communication is not particularly limited. For example, the controller 1 and the sound module 2 perform wireless communication by Bluetooth®. Further, all digital signals sent and received between the controller 1 and the sound module 2 are in accordance with a data format for MIDI (musical instrument digital interface) message.

A MIDI message sent from the controller 1 to the sound module 2 includes the play data inputted from the first to third input units 20A to 20C. The various control signals inputted from the control switches 20F are also sent from the controller 1 to the sound module 2 as a MIDI message. Further, the command gesture-inputted via the acceleration sensors 34A or the infrared sensor 34C is also sent from the controller 1 to the sound module 2 as a MIDI message. The sound module 2 memorizes the play data received from the controller 1, and controls the sound data based on the play data. For example, the sound module 2 plays automatically by replaying the sound data in accordance with the play data assigned to one to 32 steps. The sound of the replayed sound data is outputted from a speaker indirectly connected to the sound module 2 or headphones directly connected to the sound module 2. The sound module 2 executes process corresponding to the control signal or the command received from the controller 1.

Meanwhile, the MIDI message sent from the sound module 2 to the controller 1 includes, for example, a note-on command and a note-off command described above. The CPU 33 of the controller 1 illuminates an LED corresponding to any of the first to third input units 20A to 20C, the dummy input units 20D and 20E, and the control switches 20F based on the note-on command. The CPU 33 then turns off the illuminated LED based on the note-off command. For example, when performing automatic play, the sound module 2 sends note-on commands and note-off commands included in the play data to the controller 1. The note on and note off from one to 32 steps corresponding to five parts are thus displayed visually by illuminating and turning off of the 160 full color LEDs 26 arranged in a matrix. Further, the 160 LEDs 26 are arranged in a loop on the surface of the hoop shaped controller 1. The display in a loop with the continuous start and end matches the state of repeated automatic play.

Further, the MIDI message sent from the sound module 2 to the controller 1 includes, for example, a command for presentation to illuminate and turn off the 160 full color LEDs 26 arranged in a matrix in a predetermined pattern. The command for presentation is configured with combination of note on and note off of one to 32 steps×5. In addition, program data to update the firmware of the controller 1 may be sent as a MIDI message from the sound module 2 to the controller 1.

As described above, the controller 1 is capable of sending and receiving a digital signal with electronic devices other than the sound module 2, such as a personal computer and a personal data assistance, via the wireless communication module 35. For example, the controller 1 wirelessly communicates a MIDI message with a personal computer, a personal data assistance (PDA), and the like with sequence software installed therein. The sequence software causes a personal computer or a personal data assistance (PDA) to function as a software sequencer. The controller 1 can be used for general purposes as a human interface for such a software sequencer.

The controller 1 includes the charging terminal 36 illustrated in FIG. 5. The controller 1 in the present embodiment has a built-in secondary battery 39 as the power supply illustrated in FIG. 4. As the secondary battery 39, a lithium ion secondary battery, for example, removable from the controller 1 is used. The charging terminal 36 is to charge the secondary battery 39. The charging terminal 36 is directly connected to a charging terminal 45 of the sound module 2 illustrated in FIGS. 8A to 8C. The secondary battery 39 is charged with the power supplied by an AC adaptor connected to the sound module 2. The charge of the secondary battery 39 is controlled by the charge control IC 37. The charge control IC 37 optimizes charging voltage and charging current. The secondary battery control circuit 38 performs control to prevent overcharging and overdischarging of the secondary battery 39.

<Sound Module>

Figure 8A:
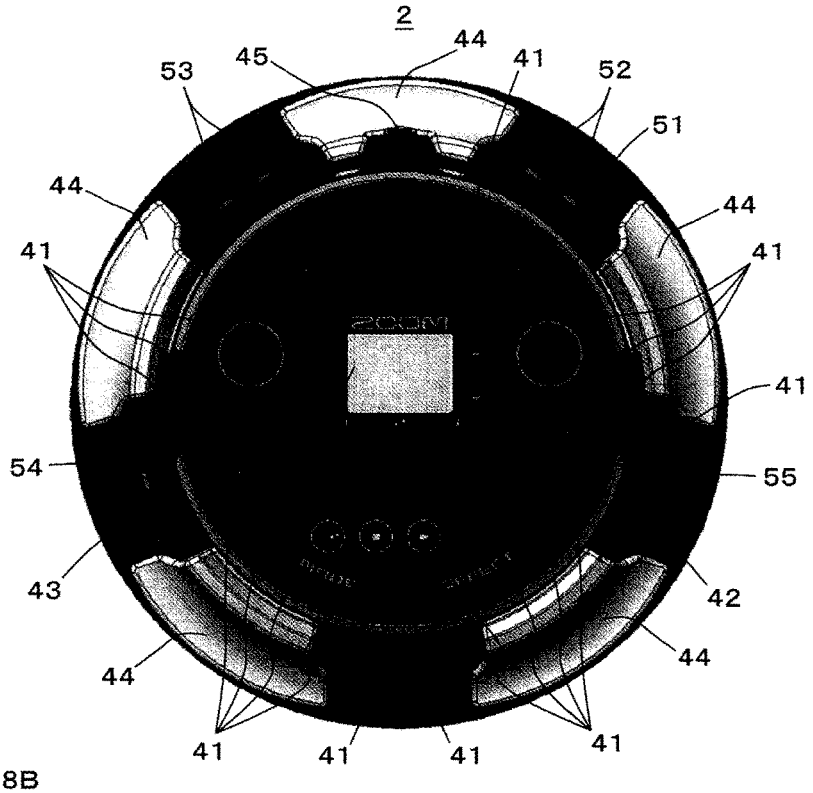
FIGS. 8A to 8C illustrate a sound module of the present embodiment, where
Figure 8B:
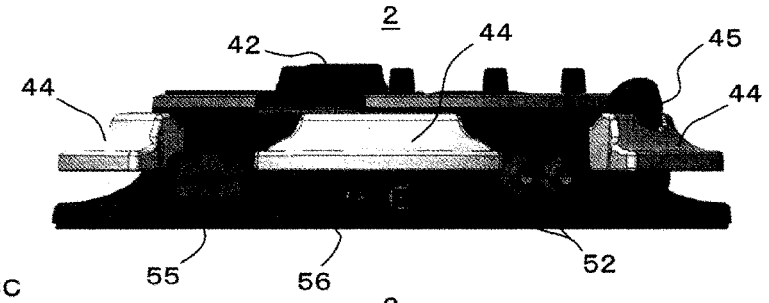
Figure 8C:
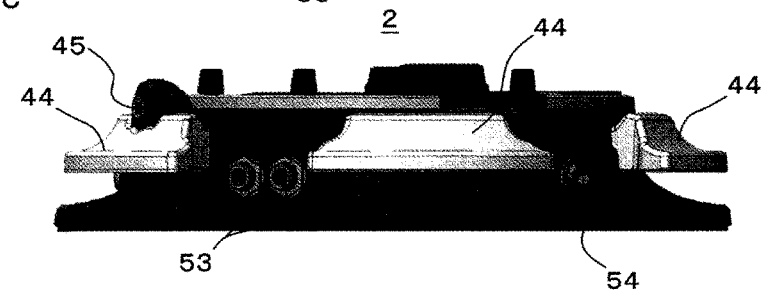

FIGS. 8A, 8B, and 8C illustrate an external appearance of the sound module 2 in the present embodiment. In FIG. 8A, a body of the sound module 2 is mainly configured with a bottom portion in a disc shape having a diameter approximately equal to the outer diameter of the controller 1 and an upper portion in a columnar shape having a diameter smaller than the inner diameter of the controller 1. The upper surface of the sound module 2 has a plurality of control switches 41, an encoder 42, a display unit 43, and a power supply switch 51 arranged thereon. Meanwhile, the side surface of the sound module 2 is provided with five placement portions 44 at regular intervals. Each placement portion 44 has an arcuate outline with the radius of curvature same as that of the bottom portion of the disc shape. The controller 1 is placed on each placement portion 44. As illustrated in FIGS. 8B and 8C, the side surface of the sound module 2 is provided with the charging terminal 45 described above. The controller 1 is charged in a state of being placed on each placement portion 44. Even when the controller 1 is in a state of being placed on each placement portion 44, a user can operate the control switches 41 and the encoder 42 and can also visually recognize the display unit 43.

The display unit 43 is not particularly limited as long as being configured to allow display of information, such as characters and images. As the display unit 43, for example, a liquid crystal display (LCD) is used. The display unit 43 displays various types of information related to the sound module 2 and the controller 1. The display unit 43 displays, for example, the state of the sound module 2 and the controller 1 and menus, items, parameters, and the like for setting and control of the sound module 2 and the controller 1.

The sound module 2 is provided with, for example, 22 control switches 41. These control switches 41 are used for various types of control over the sound module 2. The control switches 41 are used for operations such as, for example, item selection, parameter selection, switching of parts, switching of modes, and replay, stop, and memorization of data. The encoder 42 has a function of a rotating selector. The rotation of the encoder 42 enables scroll of a display screen of the display unit 43 and change of a parameter. The power supply switch 51 is used for operations of turning on/off of the sound module 2. In addition, the circular area of the sound module 2 is provided with volume control knobs respectively corresponding to external input, main output, and headphone output.

In FIG. 8B, the right side surface of the sound module 2 is provided with external input terminals 52, an SD card slot 55, and a USB-MIDI terminal 56. The external input terminals 52 are configured with two terminals of "L" and "R". To the external input terminals 52, an audio device, such as a mixer, or a musical instrument, such as a synthesizer, is connected. In an SD card inserted into the SD card slot 55, audio data inputted from the external input terminals 52 to the sound module 2, audio data to be replayed by the sound module 2, program data to update firmware, and the like are memorized. To the USB-MIDI terminal 56, a personal computer is connected. The sound module 2 sends and receives a MIDI message with the personal computer via the USB-MIDI terminal 56. In addition, the right side surface of the sound module 2 is provided with an AC adaptor port. To the AC adaptor port, the AC adaptor described above is connected.

In FIG. 8C, the left side surface of the sound module 2 is provided with main output terminals 53 and a headphone output terminal 54. The main output terminals 53 are configured with two terminals of "L" and "R". To the main output terminals 53, an audio device, such as a mixer and an amplifier, is connected. To the headphone output terminal 54, headphones are connected. In addition, the left side surface of the sound module 2 is provided with an antitheft wire lock connecting portion.

<<Circuit Configuration>>

Figure 9:
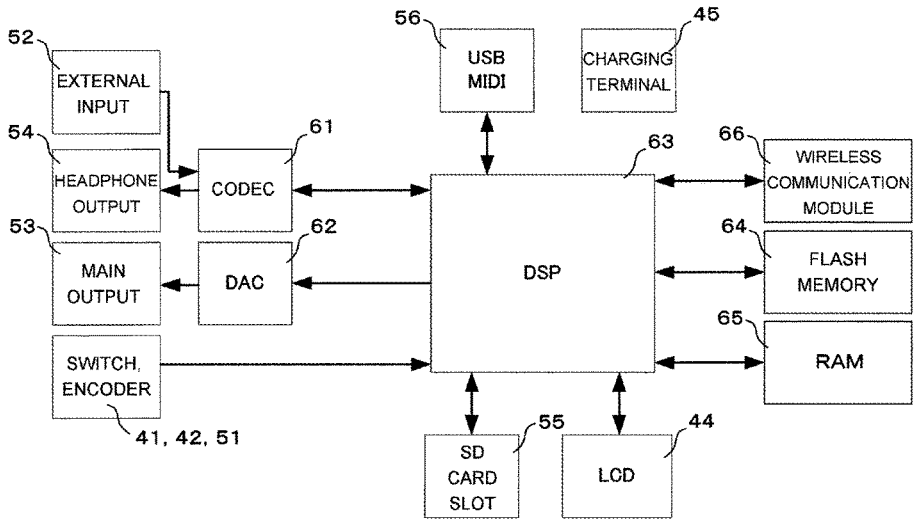
FIG. 9 is a block diagram schematically illustrating a circuit of the sound module.

The circuit configuration of the sound module 2 in the present embodiment is then described. FIG. 9 illustrates a main circuit configuration configuring the sound module 2. The sound module 2 includes a DSP (digital signal processor) 63. The DSP 63 is configured to allow real time process of a digital signal. The DSP 63 is thus capable of real time communicating a MIDI message with a device connected to the USB-MIDI terminal 56 or the wireless communication module 66. To the DSP 63, an external memory medium in which the sound data is memorized is connected. The external memory medium is, for example, a flash memory 64. The flash memory 64 as the external memory medium has a storage capacity of at least 64 M bit and preferably a storage capacity of 128 M bit or more. To the DSP 63, a RAM (random access memory) 65 is connected. The RAM 65 is, for example, a DDR2 SDRAM (double-data-rate2 synchronous dynamic random access memory). On startup of the sound module 2, the DSP 63 reads the sound data from the flash memory 64. After that, the DSP 63 temporarily memorizes the read sound data in the RAM 65. The DSP 63 replays the sound data memorized in the RAM 65 in accordance with the MIDI message inputted via the USB-MIDI terminal 56 or the wireless communication module 66. The replayed sound data is outputted from the DSP 63 as a digital signal.

The external input terminals 52 are connected to the DSP 63. To the external input terminals 52, an analog audio signal outputted from an audio device, such as a mixer, or a musical instrument, such as a synthesizer, is inputted. A codec 61 converts the analog audio signal to digital and outputs the signal to the DSP 63. The DSP 63 temporarily memorizes the digitally converted audio data in the RAM 65. The DSP 63 then memorizes the audio data memorized in the RAM 65 in the SD card inserted into the SD card slot 55. The DSP 63 is capable of replaying the audio data memorized in the SD card. The replayed audio data is outputted from the DSP 63 as a digital signal.

The headphone output terminal 54 is connected to the DSP 63 via the codec 61. The codec 61 converts the digital signal outputted from the DSP 63 to analog and outputs the signal to the headphone output terminal 54. As a result, the sound data or the audio data replayed by the DSP 63 is generated into sound from headphones connected to the headphone output terminal 54.

The main output terminals 53 are connected to the DSP 63 via a DAC (digital to analog converter) 62. The DAC 62 converts the digital signal outputted from the DSP 63 to analog and outputs the signal to the main output terminals 53. As a result, the sound data or the audio data replayed by the DSP 63 is outputted to an audio device, such as a mixer and an amplifier, connected to the main output terminals 53. The sound data or the audio data replayed by the DSP 63 is generated into sound finally from a speaker via the audio device, such as a mixer and an amplifier.

The sound module 2 in the present embodiment has a configuration in which a signal input path of the headphone output terminal 54 is different from a signal input path of the main output terminals 53. This configuration allows output of predetermined sound only to the headphone output terminal 54. For example, the sound of a metronome is outputted only to the headphone output terminal 54.

All of the control switches 41, the encoder 42, the power supply switch 51, and other operation means are connected to the DSP 63. The DSP 63 executes process corresponding to the control signal or command received from the operation means.

The display unit 43 is connected to the DSP 63. The DSP 63 controls the display unit 43 and displays various types of information on the sound module 2 and the controller 1.

The DSP 63 updates the firmware of the sound module 2. Data used for update is provided from the SD card inserted into the SD card slot 55. Data to update the controller 1 described above is also provided from the SD card inserted into the SD card slot 55. The DSP 63 converts the data for update to a MIDI message and outputs the message to the wireless communication module 66.

As already described, the sound module 2 wirelessly communicates a MIDI message with the controller 1 via the wireless communication module 66. The mode of wireless communication is not particularly limited as long as it is compatible with the wireless communication module 35 of the controller 1. As the communication mode, for example, Bluetooth® described above is applicable. The sound module 2 may wirelessly communicates a digital signal with an electronic device other than the controller 1 via the wireless communication module 66.

<Actions and Effects>

The controller 1 in the present embodiment includes the frame 10 having the three dimensional surface and the plurality of input units 20A to 20C arranged adjacent in the circumferential direction and the longitudinal direction of the three dimensional surface. This configuration allows more input units 20A to 20C to be provided on the three dimensional surface of the frame 10. As a result, the controller 1, which is easy to carry and has a hoop shape, is achieved. A user can operate the input units 20A to 20C by holding the hoop shaped controller 1 like playing a musical instrument, and further can freely move on the stage and freely move the body with the performance. In other words, the controller 1 in the present embodiment allows dynamic play by a user to fulfill the live performance more.

The controller 1 in the present embodiment configuring a step sequencer provides particularly effective display. The controller 1 includes a total of 160 input units 20A to 20C and dummy input units 20D and 20E. All input units 20A to 20E has the full color LEDs 26 and are capable of visually displaying information. The large number of input units 20A to 20E provided with a display function allows display of a state of play data of all parts assigned to one to 32 steps. For example, a user can visually confirm how the play data of each part is assigned to the entire bar based on the display of the large number of input units 20A to 20E.

Further, arrangement of the large number of input units 20A to 20E is determined by the shape of the entire frame 10. When the entire frame 10 has a hoop shape as in the present embodiment, the large number of input units 20A to 20E are arranged adjacent in a loop on the three dimensional surface of the frame 10. Such arrangement allows display of information continuously in a loop by the large number of input units 20A to 20E. The form of display in a loop matches information display during automatic play by a loop sequence.

The controller 1 in the present embodiment can provide novel operation and display that are not found in electronic musical instruments in the past. For example, arrangement of the large number of input units 20A to 20E indicates parts and steps subjected to input of play data. The user can intuitively input play data based on the arrangement of the large number of input units 20A to 20E. The display of the large number of input units 20A to 20E dynamically changes in the circumferential direction and the longitudinal direction of the three dimensional surface with the automatic play. Such display has, in addition to an effect of providing more detailed information, a presentation effect of visually expressing the music.

<Other Modifications>

The controller, the sound module, and the electronic musical instrument of the present invention are not limited to the configuration of the above embodiments. For example, the entire shape of the controller of the present invention is not limited to a circular hoop as in the embodiment. The entire frame configuring the controller of the present invention may have, as long as it has a three dimensional surface surrounding the internal space, various shapes such as, for example, a linear rod, a polygonal hoop, a U shape, a V shape, and an L shape. The number of the input units and the dummy input units configuring the controller 1 is not limited to 160 in the embodiments described above. Further, no dummy input units may be provided to configure all the input units with pressure sensitive sensors.

The electronic musical instrument of the present invention is not limited to the step sequencer including the controller and the sound module independent from each other. For example, the electronic musical instrument of the present invention may be configured with a controller and a sound module integrated with each other. The controller of the present invention is applicable to various electronic musical instruments, such as a synthesizer, a sampler, a drum machine.

REFERENCE SIGNS LIST

1 Controller
10 Frame
20A First Input Unit
20B Second Input Unit
20C Third Input Unit
20D, 20E Dummy Input Unit
20F Control Switch
21 Pressure Sensitive Sensor (Pressure Sensitive Sensor Unit)
22 Resistive Film Pattern Sheet
22*a* Resistive Film
23 Spacer
24 Wiring Pattern Sheet
24*a* Wiring Pattern
25 Pad
25*a* Press Piece
26 LED
27 AD Converter
28 Inner Wall
30 Circuit Substrate
31 Multiplexer
32 Shift Register
33 CPU
34A Acceleration Sensor
34B Vibration Motor
34C Infrared Sensor
35 Wireless Communication Module
36 Charging Terminal
37 Charge Control IC
38 Secondary Battery Control Circuit
39 Secondary Battery
2 Sound Module
41 Control Switch
42 Encoder
43 Display Unit
44 Placement Portion
45 Charging Terminal
51 Power Supply Switch
52 External Input Terminal
53 Main Output Terminal
54 Headphone Output Terminal
55 SD Card Slot
56 USB-MIDI Terminal
61 Codec
62 DAC
63 DSP
64 Flash Memory
65 RAM
66 Wireless Communication Module

The invention claimed is:

1. A controller to control an electronic musical instrument, comprising:

a plurality of input units each configured for a user to input play data; and a frame having the plurality of input units arranged therein, wherein the frame has a wall surrounding an internal space, the wall has a three dimensional surface along a longitudinal direction in which the wall extends, the plurality of input units comprise a set, and the plurality of input units comprising the set are arranged adjacent in a circumferential direction of the three dimensional surface, and a plurality of sets are arranged adjacent in the longitudinal direction in which the three dimensional surface extends.

2. The controller according to claim 1, wherein the frame has a hoop shape.

3. The controller according to claim 1, wherein the plurality of input units comprising the plurality of sets are arranged in a matrix on the three dimensional surface.

4. The controller according to claim 1, wherein the input unit comprises a pressure sensitive sensor.

5. The controller according to claim 4, wherein the pressure sensitive sensor comprises a resistive film pattern and a wiring pattern provided between a plurality of sheets.

6. The controller according to claim 4, wherein the pressure sensitive sensor comprises a resistive film pattern and a wiring pattern provided between a sheet and a substrate.

7. The controller according to claim 4, wherein the plurality of input units includes one pressure sensitive sensor unit comprising a plurality of the pressure sensitive sensors.

8. The controller according to claim 4, wherein the input unit comprises a resilient pad configured to transmit pressure to the pressure sensitive sensor.

9. The controller according to claim 1, wherein each of the plurality of input units comprises an LED for visually displaying information by turning on and off, and illuminating color.

10. The controller according to claim 1, further comprising an acceleration sensor for determining the position of the controller.

11. The controller according to claim 1, further comprising a vibration motor for transmitting rhythm tempo to the hand of the user.

12. The controller according to claim 1, further comprising an infrared sensor for detecting movement of the hand of the user.

13. The controller according to claim 1, further comprising a gyro sensor for determining the position of the controller.

14. The controller according to claim 1, wherein the electronic musical instrument is a step sequencer, the plurality of input units adjacent in the circumferential direction of the three dimensional surface are configured to be used to respectively control different sound data items, and the plurality of input units adjacent in the longitudinal direction in which the three dimensional surface extends are configured to be used to respectively control a same sound data item.

15. The controller according to claim 14, wherein the plurality of input units comprising the set correspond to one step of play, and a plurality of the sets corresponding to at least 1 to 16 steps are arranged adjacent in the longitudinal direction in which the three dimensional surface extends.

16. The controller according to claim 1, wherein the electronic musical instrument comprises a sound module configured to control the sound data based on the play data, and the controller is a device independent from the sound module and is configured to send the play data to the sound module via wireless or wired communication.

17. The controller according to claim 16, further comprising:

a control unit configured to process a signal outputted from the input unit and send the play data to the sound module; and a power supply configured to operate the controller.

18. A sound module configured to control the sound data based on the play data sent from the controller according to claim 16.

19. An electronic musical instrument, comprising the controller according to claim 1.

20. An electronic musical instrument, comprising a controller configured to control the electronic musical instrument, comprising:

a plurality of input units each configured for a user to input play data; and a frame having the plurality of input units arranged therein, wherein the frame has a wall surrounding an internal space, the wall has a three dimensional surface along a longitudinal direction in which the wall extends, the plurality of input units comprise a set, and the plurality of input units comprising the set are arranged adjacent, and wherein the electronic musical instrument comprises a sound module configured to control the sound data based on the play data, and the controller is a device independent from the sound module and is configured to send the play data to the sound module via wireless or wired communication; and wherein the sound module is configured to control the sound data based on the play data sent from the controller.

* * * * *